US006817601B2

(12) United States Patent
Schmalz et al.

(10) Patent No.: US 6,817,601 B2
(45) Date of Patent: Nov. 16, 2004

(54) BLOCK SUCTION APPARATUS

(75) Inventors: Kurt Schmalz, Dornstetten (DE); Ralf Stockburger, Glatten (DE)

(73) Assignee: J. Schmalz GmbH, Glatten (DE)

( * ) Notice: Subject to any disclaimer, the term of this patent is extended or adjusted under 35 U.S.C. 154(b) by 127 days.

(21) Appl. No.: 10/445,201

(22) Filed: May 27, 2003

(65) Prior Publication Data

US 2003/0201593 A1 Oct. 30, 2003

Related U.S. Application Data

(63) Continuation of application No. PCT/EP03/04144, filed on Apr. 22, 2003.

(30) Foreign Application Priority Data

Apr. 24, 2002 (EP) ..... 202 06 490

(51) Int. Cl.[7] ..... B25B 11/00
(52) U.S. Cl. ..... 269/21

(58) Field of Search ..... 269/21, 309, 310; 279/3; 451/388, 412; 125/35; 294/64.1, 65; 248/262, 263

(56) References Cited

U.S. PATENT DOCUMENTS 3,294,392 A * 12/1966 Dunham
6,502,808 B1 * 1/2003 Stone et al.

* cited by examiner

*Primary Examiner*—Robert C. Watson
(74) *Attorney, Agent, or Firm*—Paul Vincent

(57) ABSTRACT

A block suction apparatus for fixing plate-shaped work pieces on a fixing beam or fixing table using under-pressure has at least one support surface provided with a sealing plate having a sealing lip about its periphery. The sealing lip delimits a suction chamber and least one supporting element is provided within the suction chamber. At least one additional supporting element is also provided and is located in the direct vicinity of the sealing lip. Sagging of sections of a plate being lifted by the apparatus which project past the block suction apparatus is thereby reduced and the edge of the plate can therefore be processed with greater accuracy.

8 Claims, 2 Drawing Sheets

BLOCK SUCTION APPARATUS

This application is a continuation of PCT/EP03/04144 filed Apr. 22, 2003 and claiming Paris Convention priority to DE 20 206 490.5 the entire disclosure which are hereby incorporated by reference.

BACKGROUND OF THE INVENTION

The invention concerns a block suction apparatus for fixing plate-shaped work pieces on a fixing beam or fixing table using under-pressure, wherein at least one contact surface of the block suction apparatus comprises a sealing plate with a sealing lip at its periphery, wherein the sealing lip delimits a suction chamber, wherein at least one supporting element is provided within the suction chamber.

Block suction apparatus are generally known and are used for fixing and clamping plate-shaped work pieces on processing machines. These processing machines have fixing beams or a fixing table, with several block suction apparatus usually being disposed on several fixing beams or a fixing table, and the plate to be processes is disposed on the block suction apparatus. The plate is held for processing on the block suction apparatus through under-pressure. For under-pressure fixing of the work piece, the block suction apparatus comprises a sealing plate, which has a sealing lip delimiting a suction chamber. When this suction chamber is subjected to under-pressure, the plate is suctioned thereby changing the separation between plate and block suction apparatus. To obtain a defined position of the plate relative to the block suction apparatus and therefore relative to the fixing beam or fixing table, the block suction apparatus has at least one supporting element on which the work piece or the plate abuts after suction, and is thereby aligned relative to the fixing beam or the fixing table at a position relative to the block suction apparatus which cannot change.

Especially for large work pieces, when the edges of the work pieces greatly jut out, or when a relatively small number of block suction apparatus are used, the orientation of the plate-shaped work piece relative to the fixing beam or the fixing table is insufficient.

It is therefore the underlying purpose of the present invention to provide a block suction apparatus, which permits improved and more exact positioning of the work piece.

SUMMARY OF THE INVENTION

This object is achieved in accordance with the invention with a block suction apparatus of the above-mentioned type in that at least one additional supporting element is provided which is located in the direct vicinity of the sealing lip.

The inventive block suction apparatus comprises an additional supporting element, which is disposed close to the edge and close to the sealing lip. This is advantageous in that a section of the plate projecting past the block suction apparatus is supported in as optimum a fashion as is possible with the block suction apparatus. Sagging of the section of the plate projecting past the block suction apparatus is thereby reduced and the edge of the plate can therefore be processed with greater accuracy.

In a further development, the additional supporting element is located in the region of a corner of the contact surface. In particular, the projecting corner-regions of the plate, which are relatively instable, are thereby supported by the additional supporting element of the inventive block suction apparatus and are aligned with the fixing beam or fixing table.

In a preferred embodiment, several additional supporting elements are provided. They are preferably located in the corner regions of the sealing plate such that the block suction apparatus has equally good supporting properties in all directions.

These several additional supporting elements are preferably uniformly distributed over the contact surface. In particular, the additional supporting elements form a uniform grid together with the conventional supporting elements, in particular along parallel lines.

The sealing plate has an opening for the additional supporting element, which provides passage of the supporting element through the sealing plate. This opening is fashioned to terminate on the supporting element in a sealing fashion to prevent leaking air from being suctioned through this opening.

To prevent slippage of the plate towards the block suction apparatus, the invention provides that the sealing plate has a base plate comprising the opening and a bead, wherein the bead protrudes beyond the base plate and surrounds the opening. This bead optimally supports the base plate against lateral displacement on the additional supporting element. The bead projects past the additional supporting element in the direction towards the work piece such that the work piece abuts the bead and the bead holds the work piece. The bead consists of compressible elastic material and the projecting part of the bead is compressed when the work piece is suctioned until the work piece abuts the supporting element. The bead that consists of a slip-reducing material abuts with a predetermined force on the work piece and prevents displacement of the work piece relative to the block suction apparatus. The additional supporting element preferably has the shape of a pin. A cylindrical pin shape is advantageous in that the opening in the base plate may be circular to provide simple sealing and facilitate production of the additional supporting element.

Further advantages, features and details of the invention can be extracted from the dependent claims and the following detailed description of a particularly preferred embodiment with reference to the drawing. The features shown in the drawing and mentioned in the claims and in the description may be essential to the invention either individually or collectively in arbitrary combination.

DESCRIPTION OF THE PREFERRED EMBODIMENTS

Figure 1:
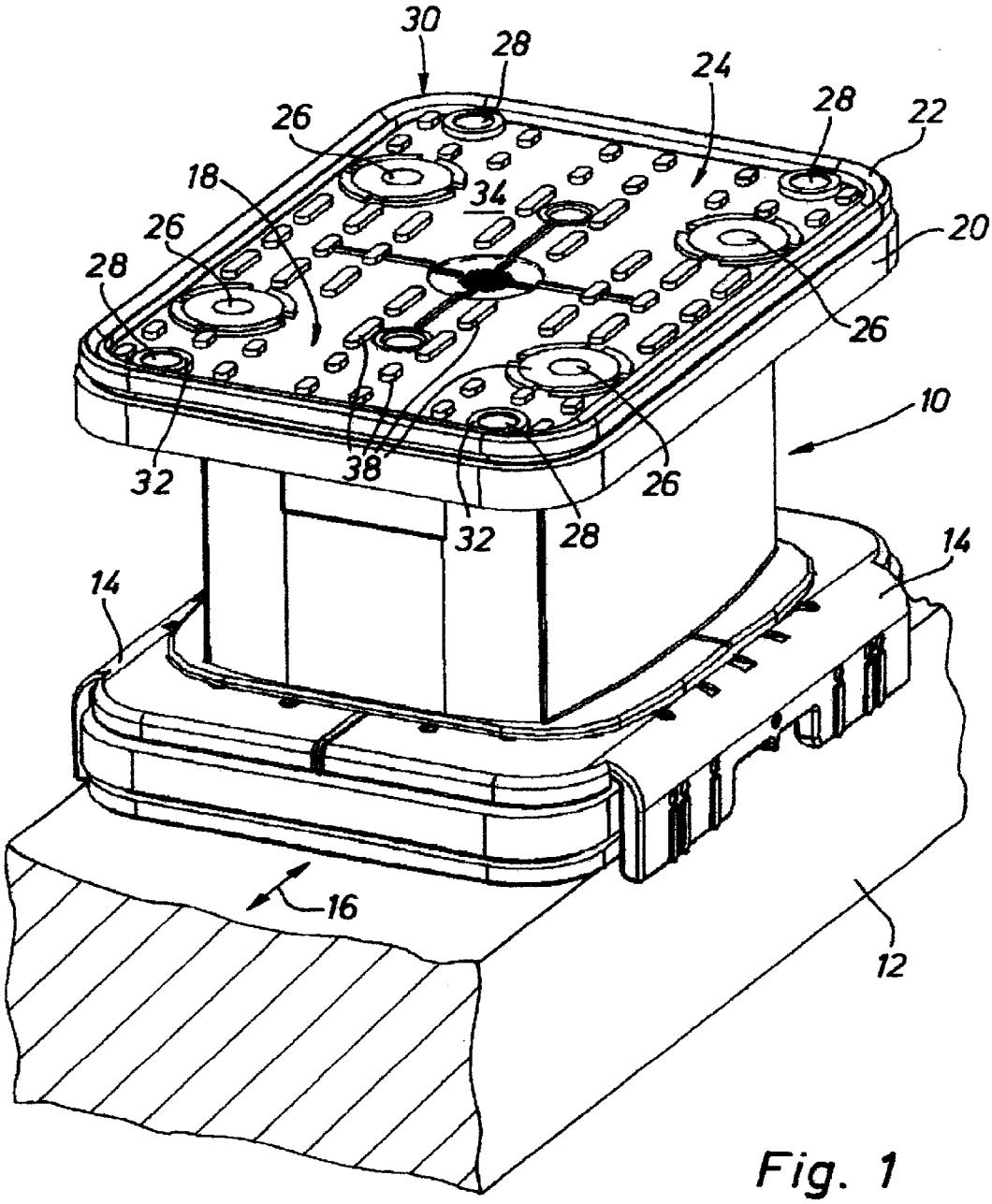
FIG. 1 shows a perspective view of a block suction apparatus with mounted sealing plate.

FIG. 1 shows a perspective view of a block suction apparatus, designated in its totality with 10, which is mounted onto a fixing beam 12. The block suction apparatus 10 is fixed by aprons 14 to prevent lateral displacement. The block suction apparatus 10 can be displaced along the fixing beam 12 in the direction of the double arrow 16. The block suction apparatus 10 has a sealing plate 20 on its suction side 18, which comprises a sealing lip 22 on its side facing the work piece (not shown). The sealing lip 22 delimits a suction chamber 24, which is subjected to under-pressure to fix the work piece.

Four supporting elements 26 are provided relatively far inside the suction chamber 24 and four additional supporting elements 28 are provided relatively far outside. The additional supporting elements 28 are disposed in the direct vicinity of the sealing lip 22 and are located outside of the region of each corner 30 of the sealing plate 20.

Each additional supporting element is surrounded by a bead 32 which projects past the base plate 34 of the sealing plate 20 and also past the additional supporting element 28. The bead 32 consists of a compressible elastic material, in particular of plastic material, such that it can be compressed during suctioning of the work piece until the work piece is supported on the upper side 36 of the additional supporting element 28 thereby defining the position of the work piece relative to the block suction apparatus 10.

In addition to the bead 32, the sealing plate 20 has further wart-like projections 38 which prevent slippage of the work piece.

Figure 2:
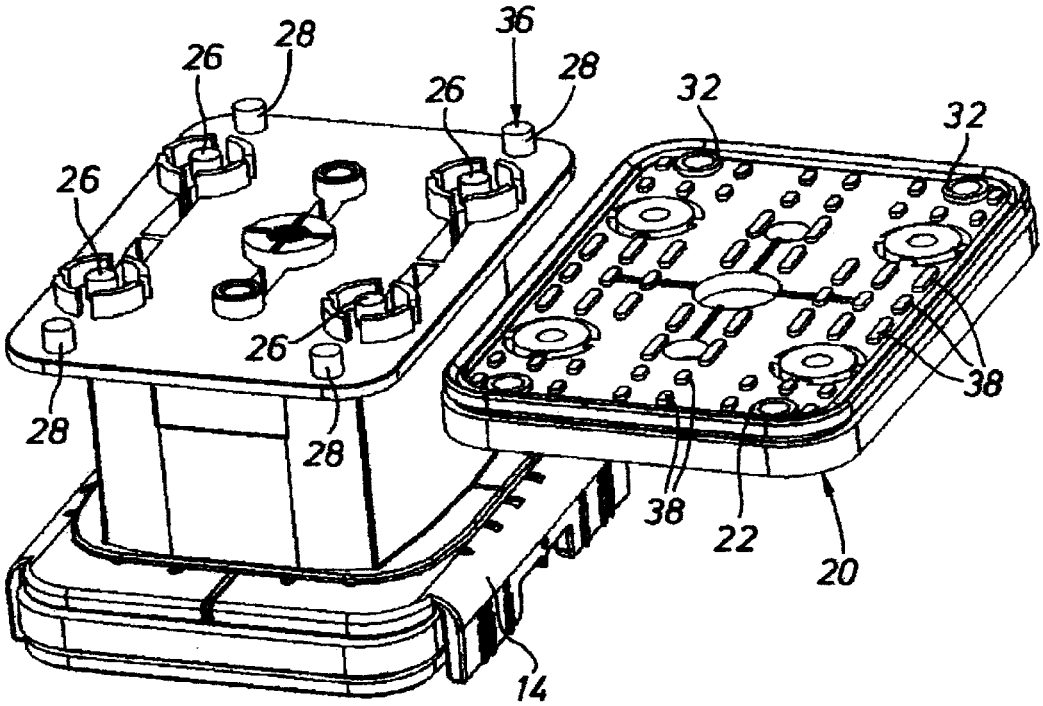
FIG. 2 shows the block suction apparatus in accordance with FIG. 1 with removed sealing plate.

FIG. 2 clearly shows the orientation of the supporting elements, 26 and 28 which are regularly spaced on the block suction apparatus 10, disposed in mutually parallel lines. As is also shown, the supporting elements 26 and 28 have a cylindrical pin shape—a shape that is easy to seal. FIG. 2 also shows that the additional supporting elements 28 are disposed relatively far in an outward direction and are closely surrounded by the sealing lip 22.

We claim:

1. A block suction device for fixing plate-shaped workpieces on a fixing beam or fixing table using vacuum, the device comprising:

a housing and support structure, said housing and support structure having an upper surface with a defined position relative to the fixing beam or fixing table;

a sealing plate mounting on said upper surface of said housing and support structure, said sealing plate having a sealing lip about a periphery thereof, said sealing lip delimiting a suction chamber, said sealing plate having corner openings directly adjacent to said sealing lip; and corner support elements cooperating with said upper surface of said housing and support structure, each corner support element positioned and dimensioned to pass through one of said corner openings in said sealing plate.

2. The block suction device of claim 1, wherein each of said corner support elements is located in a corner region of said sealing plate.

3. The block suction device of claim 1, wherein said corner support elements are uniformly distributed about said upper surface of said housing and support structure.

4. The block suction device of claim 1, wherein said sealing plate comprises a floor having said corner openings, wherein each corner opening is surrounded by a bead whose edge protrudes past said floor.

5. The block suction device of claim 4, wherein each bead protrudes past one associated corner support element.

6. The block suction device of claim 4, wherein each bead consists essentially of a compressible elastic material.

7. The block suction device of claim 4, wherein each bead is made from a slip-reducing material.

8. The block suction device of claim 1, wherein at least one of said corner support elements has a pin-shape.

* * * * *